US008227155B2

(12) United States Patent
Wu et al.

(10) Patent No.: US 8,227,155 B2
(45) Date of Patent: Jul. 24, 2012

(54) EPOXYSILANE HOLE BLOCKING LAYER PHOTOCONDUCTORS

(75) Inventors: Jin Wu, Webster, NY (US); Sherri A Toates, Webster, NY (US); J. Robinson Cowdery-Corvan, Webster, NY (US); Mark Muscato, Webster, NY (US); Richard A Williams, Savannah, NY (US); Marc J Livecchi, Rochester, NY (US); Linda L Ferrarese, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 484 days.

(21) Appl. No.: 12/511,128

(22) Filed: Jul. 29, 2009

(65) Prior Publication Data

US 2011/0027705 A1 Feb. 3, 2011

(51) Int. Cl.
*G03G 5/14* (2006.01)

(52) U.S. Cl. ..... 430/64; 430/58.8; 430/58.75; 430/60

(58) Field of Classification Search ..... 430/64, 430/60, 58.8, 58.75, 59.5
See application file for complete search history.

(56) References Cited

U.S. PATENT DOCUMENTS

| | | | | |
|---|---|---|---|---|
| 4,273,846 | A * | 6/1981 | Pai et al. | 430/58.75 |
| 4,464,450 | A | 8/1984 | Teuscher | |
| 4,579,801 | A | 4/1986 | Yashiki | |
| 4,921,773 | A | 5/1990 | Melnyk et al. | |
| 5,385,796 | A | 1/1995 | Spiewak et al. | |
| 5,443,934 | A * | 8/1995 | Suzuki et al. | 430/64 |
| 5,449,573 | A | 9/1995 | Aoki et al. | |
| 5,489,496 | A | 2/1996 | Katayama et al. | |
| 5,795,690 | A * | 8/1998 | Takegawa et al. | 430/58.25 |
| 5,928,824 | A | 7/1999 | Obinata et al. | |
| 6,015,645 | A | 1/2000 | Murti et al. | |
| 6,156,468 | A | 12/2000 | Wehelie et al. | |
| 6,177,219 | B1 | 1/2001 | Yuh et al. | |
| 6,255,027 | B1 | 7/2001 | Wehelie et al. | |
| 6,913,863 | B2 | 7/2005 | Wu et al. | |
| 7,312,007 | B2 | 12/2007 | Lin et al. | |
| 7,544,452 | B2 | 6/2009 | Wu et al. | |
| 7,560,208 | B2 | 7/2009 | Lin et al. | |
| 2007/0243476 | A1 | 10/2007 | Lin et al. | |
| 2009/0035673 | A1 | 2/2009 | Wu | |
| 2009/0035674 | A1 | 2/2009 | Wu | |
| 2009/0035675 | A1 | 2/2009 | Wu | |
| 2009/0035676 | A1 | 2/2009 | Wu | |
| 2011/0027706 | A1 | 2/2011 | Wu et al. | |
| 2011/0027707 | A1 | 2/2011 | Wu | |
| 2011/0027708 | A1 | 2/2011 | Wu | |

OTHER PUBLICATIONS

Borsenberger, Paul M. et al. Organic Photoreceptor for Imaging Systems, New York: Marcel-Dekker, Inc. (1993) pp. 289-297.*
Jin Wu, U.S. Appl. No. 12/059,536 on Carbazole Hole Blocking Layer Photoconductors, filed Mar. 31, 2008.
Jin Wu, U.S. Appl. No. 12/129,948 on Aminosilane and Self Crosslinking Acrylic Resin Hole Blocking Layer Photoconductors, filed May 30, 2008.
Jin Wu, U.S. Appl. No. 12/164,338 on Phenolic Resin Hole Blocking Layer Photoconductors, filed Jun. 30, 2008.

* cited by examiner

*Primary Examiner* — Christopher Rodee
(74) *Attorney, Agent, or Firm* — Eugene O. Palazzo

(57) ABSTRACT

A photoconductor that includes, for example, a substrate, an optional ground plane layer, an undercoat layer thereover, wherein the undercoat layer contains an aminosilane and an epoxysilane, a photogenerating layer, and at least one charge transport layer.

30 Claims, No Drawings

EPOXYSILANE HOLE BLOCKING LAYER PHOTOCONDUCTORS

CROSS REFERENCE TO RELATED APPLICATIONS

Illustrated in copending U.S. application Ser. No. 12/511,139, U.S. Publication No. 20110027707, filed Jul. 29, 2009 on SN Containing Hole Blocking Layer Photoconductor, the disclosure of which is totally incorporated herein by reference, is a photoconductor comprising a substrate, a first layer, and an undercoat layer thereover, and wherein the undercoat layer comprises an aminosilane and a SN containing compound; a photogenerating layer, and a charge transport layer, and wherein the SN containing compound is one of

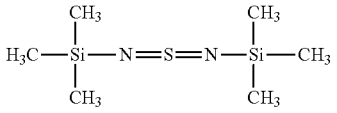

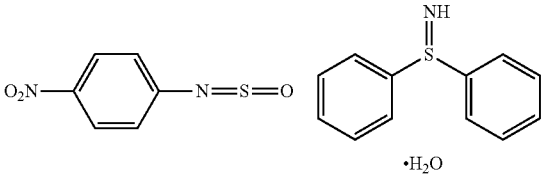

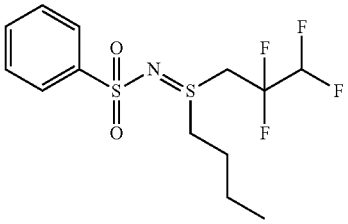

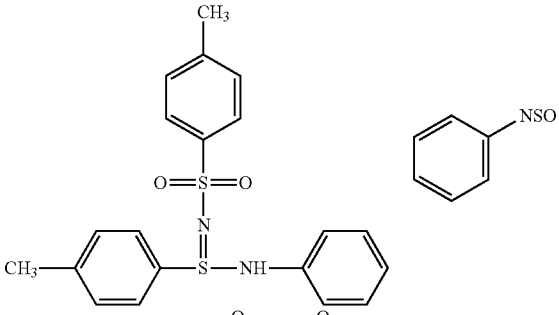

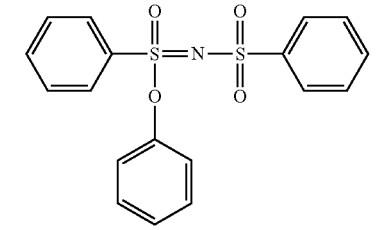

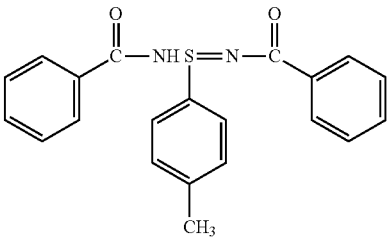

-continued

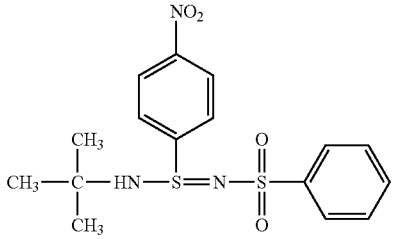

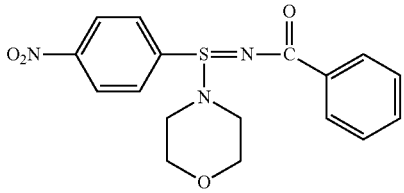

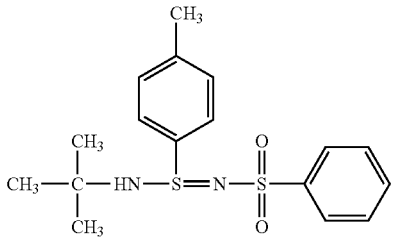

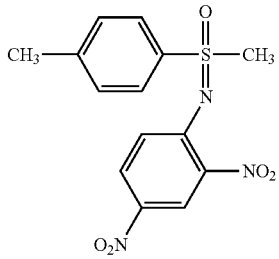

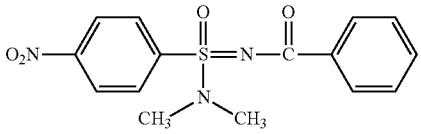

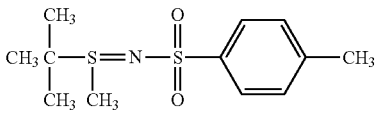

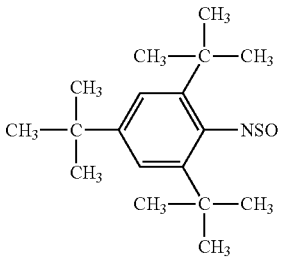

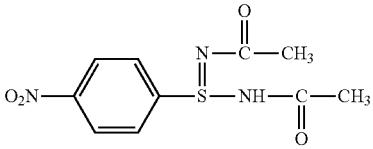

-continued

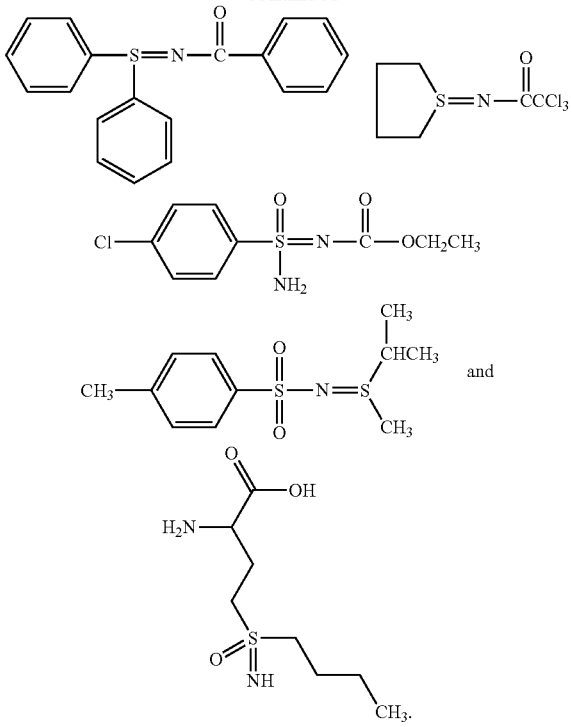

Illustrated in copending U.S. application Ser. No. 12/511,133, U.S. Publication No. 20110027706, filed Jul. 29, 2009 on Melamine Polymer Hole Blocking Layer Photoconductors, the disclosure of which is totally incorporated herein by reference, is a photoconductor comprising a substrate; a ground plane layer; an undercoat layer thereover, and wherein the undercoat layer comprises an aminosilane and a melamine polymer; a photogenerating layer, and a charge transport layer.

Illustrated in copending U.S. application Ser. No. 12/511,146, U.S. Publication No. 20110027708, filed Jul. 29, 2009 on Aminosilane Urea Containing Hole Blocking Layer Photoconductors, the disclosure of which is totally incorporated herein by reference, is a photoconductor comprising a substrate, a ground plane layer, an undercoat layer thereover, and wherein the undercoat layer comprises an aminosilane and a urea resin; a photogenerating layer, and a charge transport layer.

Illustrated in copending U.S. application Ser. No. 12/129,948, now U.S. Pat. No. 8,048,601, filed May 30, 2008 on Aminosilane and a Self Crosslinking Acrylic Resin Hole Blocking Layer Photoconductors, the disclosure of which is totally incorporated herein by reference, is a photoconductor comprising a substrate; a ground plane layer; an undercoat layer thereover wherein the undercoat layer comprises an aminosilane and a crosslinked acrylic resin; a photogenerating layer; and at least one charge transport layer.

Illustrated in copending U.S. application Ser. No. 12/059,536, now U.S. Pat. No. 7,794,906, filed Mar. 31, 2008, entitled Carbazole Hole Blocking Layer Photoconductors, the disclosure of which is totally incorporated herein by reference, is a photoconductor that includes, for example, a substrate; an undercoat layer thereover wherein the undercoat layer contains a metal oxide and a carbazole containing compound; a photogenerating layer; and at least one charge transport layer.

Illustrated in copending U.S. application Ser. No. 11/831,440, U.S. Publication No. 20090035673, now U.S. Pat. No. 7,871,748, filed Jul. 31, 2007, entitled Iron Containing Hole Blocking Layer Containing Photoconductors, the disclosure of which is totally incorporated herein by reference, is a photoconductor comprising a substrate; an undercoat layer thereover wherein the undercoat layer comprises a metal oxide, and an iron containing compound; a photogenerating layer; and at least one charge transport layer.

Illustrated in copending U.S. application Ser. No. 11/831,453, U.S. Publication No. 20090035674, U.S. Pat. No. 7,670,737, filed Jul. 31, 2007, entitled UV Absorbing Hole Blocking Layer Containing Photoconductors, the disclosure of which is totally incorporated herein by reference, is a photoconductor comprising a substrate; an undercoat layer thereover wherein the undercoat layer comprises a metal oxide, and an ultraviolet light absorber component; a photogenerating layer; and at least one charge transport layer.

Illustrated in copending U.S. application Ser. No. 11/831,476, U.S. Publication No. 20090035676, now U.S. Pat. No. 7,851,115, filed Jul. 31, 2007, entitled Iodonium Hole Blocking Layer Photoconductor, is a photoconductor comprising a substrate; an undercoat layer thereover wherein the undercoat layer comprises a metal oxide and an iodonium containing compound; a photogenerating layer; and at least one charge transport layer.

Illustrated in copending U.S. application Ser. No. 11/831,469, U.S. Publication No. 20090035675, now U.S. Pat. No. 7,867,676, filed Jul. 11, 2007, entitled Copper Containing Hole Blocking Layer Photoconductors, the disclosure of which is totally incorporated herein by reference, is a photoconductor comprising a substrate; an undercoat layer thereover wherein the undercoat layer comprises a metal oxide, and a copper containing compound; a photogenerating layer; and at least one charge transport layer.

Illustrated in copending U.S. application Ser. No. 11/403,981, U.S. Publication No. 20070243476, now U.S. Pat. No. 7,604,914, filed Apr. 13, 2006, entitled Imaging Members, the disclosure of which is totally incorporated herein by reference, is an electrophotographic imaging member, comprising a substrate, an undercoat layer disposed on the substrate, wherein the undercoat layer comprises a polyol resin, an aminoplast resin, and a metal oxide dispersed therein; and at least one imaging layer formed on the undercoat layer, and wherein the polyol resin is, for example, selected from the group consisting of acrylic polyols, polyglycols, polyglycerols, and mixtures thereof.

In copending U.S. application Ser. No. 12/164,338, U.S. Publication No. 20090325090, filed Jun. 30, 2008 on Thiophosphate Containing Photoconductors, the disclosure of which is totally incorporated herein by reference, there is disclosed a photoconductor comprising a substrate, a ground plane layer, an undercoat layer thereover wherein the undercoat layer comprises an aminosilane and a phenolic resin, a photogenerating layer, and a charge transport layer.

The appropriate components and processes, number and sequence of the layers, component and component amounts in each layer, and the thicknesses of each layer of the above copending applications, may be selected for the present disclosure photoconductors in embodiments thereof.

BACKGROUND

There are disclosed herein hole blocking layers, and more specifically, photoconductors containing a hole blocking layer or undercoat layer (UCL) comprised, for example, of an aminosilane and an epoxysilane, and which layer is coated or deposited on a supporting substrate, or on a first layer like a ground plane layer of, for example, titanium, zirconium, aluminum or gold.

In embodiments, photoconductors comprised of the disclosed hole blocking or undercoat layer enables, for example, the blocking of or minimization of the movement of holes or positive charges generated from the ground plane layer; and excellent cyclic stability, and thus color print stability, especially for xerographic generated color copies. Excellent cyclic stability of the photoconductor refers, for example, to almost no or minimal change in a generated known photoinduced discharge curve (PIDC), especially no or minimal residual potential cycle up after a number of charge/discharge cycles of the photoconductor, for example about 275 kilocycles, or xerographic prints of, for example, from about 80 to about 200 kiloprints. Excellent color print stability refers, for example, to substantially no or minimal change in solid area density, especially in 60 percent halftone prints, and no or minimal random color variability from print to print after a number of xerographic prints, for example 50 kiloprints.

Further, in embodiments the photoconductors disclosed may, it is believed, permit the minimization or substantial elimination of undesirable ghosting on developed images, such as xerographic images, including excellent ghosting at various relative humidities; excellent cyclic and stable electrical properties; possess in embodiments acceptable charge deficient spots (CDS); and compatibility with the photogenerating and charge transport resin binders, such as polycarbonates and acceptable photoconductor lateral charge migration (LCM) characteristics. Charge blocking layer and hole blocking layer are generally used interchangeably with the phrase "undercoat layer".

The need for excellent print quality in xerographic systems is of value, especially with the advent of color. Common print quality issues can be dependent on the components of the undercoat layer (UCL). When the undercoat layer is considered too thin for some uses, then incomplete coverage of the substrate may sometimes result due to wetting problems on localized unclean substrate surface areas. This incomplete coverage may produce pin holes which can, in turn, produce print defects such as charge deficient spots (CDS) and bias charge roll (BCR) leakage breakdown. Other problems include image "ghosting" resulting from, it is believed, the accumulation of charge somewhere in the photoreceptor. Removing trapped electrons and holes residing in the imaging members is a factor in preventing ghosting. During the exposure and development stages of xerographic cycles, the trapped electrons are mainly at or near the interface between the charge generation layer (CGL) and the undercoat layer (UCL), and holes are present mainly at or near the interface between the charge generation layer and the charge transport layer (CTL). The trapped charges can migrate according to the electric field during the transfer stage where the electrons can move from the interface of CGL/UCL to CTL/CGL, or the holes from CTL/CGL to CGL/UCL, and become deep traps that are no longer mobile. Consequently, when a sequential image is printed, the accumulated charge results in image density changes in the current printed image that reveals the previously printed image. Thus, there is a need to minimize or eliminate charge accumulation in photoreceptors without sacrificing the desired thickness of the undercoat layer, and a need for permitting the UCL to properly adhere to the other photoconductive layers, such as the photogenerating layer, for extended time periods, such as for example, about 1,200,000 simulated xerographic imaging cycles. Thus, a number of conventional materials used for the undercoat or blocking layer possess a number of disadvantages resulting in adverse print quality characteristics. For example, ghosting, charge deficient spots, and bias charge roll leakage breakdown are problems that commonly occur. With regard to ghosting, which is believed to result from the accumulation of charge somewhere in the photoconductor, consequently, when a sequential image is printed, the accumulated charge results in image density change in the current printed image that reveals the previously printed image.

Undercoat layers of a certain thickness are sometimes desirable for xerographic photoconductors as such layers permit photoconductor life extension and carbon fiber resistance. Furthermore, thick undercoat layers permit the use of economical substrates in the photoreceptors. However, due primarily to insufficient electron conductivity in dry and cold environments, the residual potential in conditions, such as 10 percent relative humidity and 70° F., can be high when the undercoat layer is thicker than about 15 microns, and moreover, the adhesion of the UCL may be poor, disadvantages avoided or minimized with the UCL of the present disclosure.

Also included within the scope of the present disclosure are methods of imaging and printing with the photoconductive devices illustrated herein. These methods generally involve the formation of an electrostatic latent image on the imaging member, followed by developing the image with a toner composition comprised, for example, of a thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members, photoconductor drums, and flexible belts disclosed herein can be selected for the Xerox Corporation iGEN3® machines that generate with some versions over 100 copies per minute. Processes of imaging, especially xerographic imaging and printing, including digital, and/or high speed color printing, are thus encompassed by the present disclosure.

The photoconductors disclosed herein are, in embodiments, sensitive in the wavelength region of, for example, from about 400 to about 900 nanometers, and in particular from about 650 to about 850 nanometers, thus diode lasers can be selected as the light source.

REFERENCES

Illustrated in U.S. Pat. No. 7,544,452 are binders containing metal oxide nanoparticles and a co-resin of phenolic resin and aminoplast resin, and an electrophotographic imaging member undercoat layer containing the binders.

Illustrated in U.S. Pat. No. 7,560,208 is a photoconductor member comprising a substrate; an undercoat layer thereover wherein the undercoat layer comprises a polyol resin, an aminoplast resin, a polyester adhesion component and a metal oxide; and at least one imaging layer formed on the undercoat layer.

Illustrated in U.S. Pat. No. 6,913,863 is a photoconductive imaging member comprised of an optional supporting substrate, a hole blocking layer thereover, a photogenerating layer, and a charge transport layer, and wherein the hole blocking layer is comprised of a metal oxide, a mixture of a mixture of phenolic resins, and wherein at least one of the resins contains two hydroxy groups.

Illustrated in U.S. Pat. Nos. 6,255,027; 6,177,219, and 6,156,468 are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM®, available from OxyChem. Company.

Illustrated in U.S. Pat. No. 6,015,645 is a photoconductive imaging member comprised of a supporting substrate, a hole blocking layer, an optional adhesive layer, a photogenerating layer, and a charge transport layer, and wherein the blocking layer is comprised of a polyhaloalkylstyrene.

In U.S. Pat. No. 4,921,769, there are illustrated photoconductive imaging members with blocking layers of certain polyurethanes.

A number of photoconductors are disclosed in U.S. Pat. No. 5,489,496; U.S. Pat. No. 4,579,801; U.S. Pat. No. 4,518,669; U.S. Pat. No. 4,775,605; U.S. Pat. No. 5,656,407; U.S. Pat. No. 5,641,599; U.S. Pat. No. 5,344,734; U.S. Pat. No. 5,721,080; U.S. Pat. No. 5,017,449, U.S. Pat. No. 6,200,716; U.S. Pat. No. 6,180,309; and U.S. Pat. No. 6,207,334.

A number of undercoat or charge blocking layers are disclosed in U.S. Pat. No. 4,464,450; U.S. Pat. No. 5,449,573; U.S. Pat. No. 5,385,796; U.S. Pat. No. 5,928,824, and U.S. Pat. No. 7,312,007.

SUMMARY

According to embodiments illustrated herein, and wherein ghosting is minimized or substantially eliminated, in xerographic printed images there are provided photoconductors that enable, it is believed, acceptable print quality in systems with high transfer current and improved CDS characteristics as compared, for example, to a similar photoconductor that is free of the epoxysilane disclosed herein.

Embodiments disclosed herein also include a photoconductor comprising a substrate, a ground plane layer, and an undercoat layer as illustrated herein, disposed, or deposited on the ground plane layer, a photogenerating layer, and a charge transport layer; a photoconductor comprised of a substrate, an undercoat layer disposed on the substrate, wherein the undercoat layer comprises an aminosilane and an epoxysilane, which primarily functions to achieve the minimization of CDS, and excellent cyclic stability for the photoconductor, thus color stability for the xerographic prints.

EMBODIMENTS

In aspects thereof, there is disclosed herein a photoconductor comprising a substrate, an optional ground plane layer, an undercoat layer thereover wherein the undercoat layer comprises an aminosilane and an epoxysilane, a photogenerating layer, and at least one charge transport layer; a photoconductor comprising a substrate, an undercoat layer thereover comprised of a mixture of an aminosilane and an epoxysilane, and thereover in sequence a photogenerating layer, and a charge transport layer; a rigid drum or flexible belt photoconductor comprising in sequence a supporting substrate, a hole blocking layer comprised of an aminosilane and an epoxysilane mixture, a photogenerating layer, and a charge transport layer; a photoconductor comprising a substrate, an undercoat layer thereover wherein the undercoat layer comprises an aminosilane and an epoxysilane, a charge photogenerating layer, and at least one charge transport layer, where at least one is, for example, from 1 to about 7, from 1 to about 5, from 1 to about 3, 1, or 2 layers; a photoconductor comprising a supporting substrate, a ground plane layer like titanium, zirconium, aluminum or gold, an undercoat layer thereover comprised of an aminosilane and an epoxysilane, a photogenerating layer, and a charge, especially hole, transport layer; a rigid drum or flexible belt photoconductor comprising in sequence a supporting substrate, such as a nonconductive substrate, thereover a ground plane layer; a hole blocking layer comprised of an aminosilane and an epoxysilane, a photogenerating layer, and a charge transport layer; a photoconductive member or device comprising a substrate, the robust undercoat layer illustrated herein, and at least one imaging layer, such as a photogenerating layer and a charge transport layer or layers, formed on the undercoat layer; a photoconductor wherein the photogenerating layer is situated between the charge transport layer and the undercoat layer present on the substrate, and which layer contains a resin binder; and an electrophotographic imaging member, which generally comprises at least a substrate layer, an undercoat layer as illustrated herein, and deposited on the undercoat layer in sequence a photogenerating layer comprised of a photogenerating component like a pigment and a polymer binder, and a charge transport layer.

Ground Plane Layer Examples

Examples of ground plane layers are aluminum, titanium, titanium/zirconium, gold and other known suitable components. The thickness of the metallic ground plane is, for example, from about 10 to about 100 nanometers. Specifically, the gold ground plane in embodiments is from about 20 to about 50 nanometers, and more specifically, from about 25 to about 45 nanometers, and yet more specifically, about 35 nanometers in thickness, and the titanium or titanium/zirconium ground plane is, for example, from about 10 to about 30 nanometers, and more specifically, about 20 nanometers in thickness.

Undercoat Layer Component Examples

The undercoat layer in embodiments may be comprised of a number of suitable known components, in addition to the aminosilane and epoxysilane mixture.

In embodiments, the epoxysilane, which can be included in the hole blocking layer in various effective amounts, such as from about 1 to about 50 weight percent, from about 5 to about 40 weight percent, from about 10 to about 30 weight percent, from 10 to about 20 weight percent, and more specifically, 10 or 20 weight percent, can be represented by

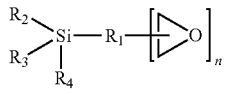

wherein $R_1$ is an alkylene group or an alkoxy group containing, for example, from 1 to about 18, from 1 to about 10, or from 1 to about 6 carbon atoms, and connecting to either one or two sites on the epoxy ring; $R_2$, $R_3$ and $R_4$ are independently selected from an alkyl group or an alkoxy group containing, for example, from 1 to about 10 carbon atoms, and more specifically, from 1 to about 4 carbon atoms; n is the number of the epoxy rings of, for example, from 1 to about 8, and more specifically, from 1 to about 4.

Examples of epoxysilanes incorporated into the undercoat are represented by

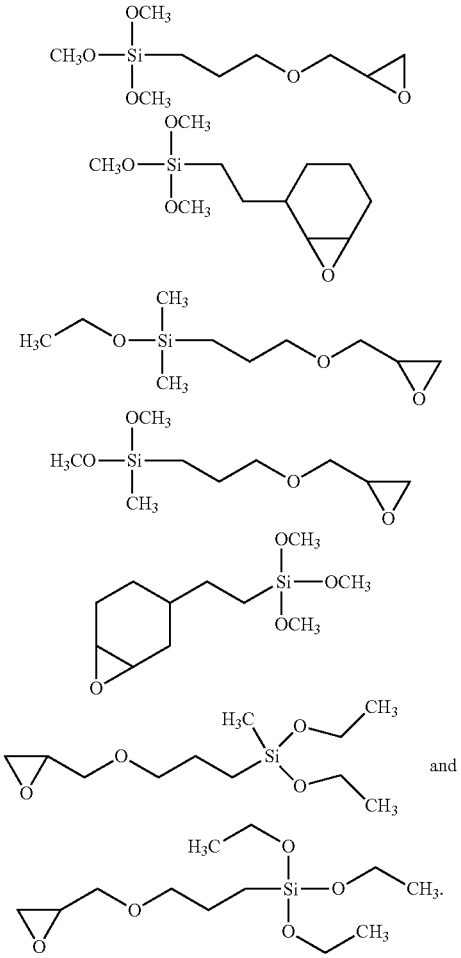

Specific examples of epoxysilanes selected for the undercoat layer are (3-glycidoxypropyl)trimethoxysilane, 2-(3,4-epoxycyclohexyl)ethyltrimethoxysilane, (3-glycidoxypropyl)triethoxysilane, (3-glycidoxypropyl) methyldiethoxysilane, 3-glycidoxypropyldimethylethoxysilane, 3-glycidoxypropyldimethoxymethylsilane, trimethoxy[2-(7-oxabicyclo[4.1.0] hept-3-yl)ethyl]silane, and the like, and mixtures thereof.

Aminosilane examples included in the hole blocking layer are, for example, represented by

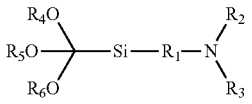

wherein $R_1$ is an alkylene group containing, for example, from 1 to about 25 carbon atoms; $R_2$ and $R_3$ are independently selected from the group consisting of at least one of hydrogen, alkyl containing, for example, from 1 to about 12 carbon atoms, and more specifically, from 1 to about 4 carbon atoms; aryl with, for example, from about 6 to about 42 carbon atoms, such as a phenyl group; and a poly(alkylene like ethylene amino) group; and $R_4$, $R_5$, and $R_6$ are independently selected from an alkyl group containing, for example, from 1 to about 10 carbon atoms, and more specifically, from 1 to about 4 carbon atoms.

Aminosilane specific examples include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-propionate, (N,N'-dimethyl 3-amino)propyl triethoxysilane, N,N-dimethylaminophenyl triethoxysilane, trimethoxysilyl propyldiethylene triamine, and the like, and mixtures thereof. Yet more specific aminosilane materials are 3-aminopropyl triethoxysilane (γ-APS), N-aminoethyl-3-aminopropyl trimethoxysilane, (N,N'-dimethyl-3-amino)propyl triethoxysilane, and mixtures thereof.

The aminosilane may be hydrolyzed to form a hydrolyzed silane solution before being added into the final undercoat coating solution or dispersion. During hydrolysis of the aminosilanes, the hydrolyzable groups, such as alkoxy groups, are replaced with hydroxyl groups. The pH of the hydrolyzed silane solution can be controlled to obtain excellent characteristics on curing, and to result in electrical stability. A solution pH of, for example, from about 4 to about 10 can be selected, and more specifically, a pH of from about 7 to about 8. Control of the pH of the hydrolyzed silane solution may be affected with any suitable material, such as generally organic or inorganic acids. Typical organic and inorganic acids include acetic acid, citric acid, formic acid, hydrogen iodide, phosphoric acid, hydrofluorosilicic acid, p-toluene sulfonic acid, and the like.

Also, in embodiments, the aminosilane selected for the hole blocking layer can be comprised of the aminosilanes as illustrated, for example, in copending U.S. application Ser. No. 12/129,948, now U.S. Pat. No. 8,048,601, and U.S. application Ser. No. 12/164,338, now U.S. Publication 20090325090, the disclosures of which are totally incorporated herein by reference.

Various amounts of the epoxysilane can be included in the hole blocking layer as illustrated herein, and such as, for example, from about 0.1 to about 50 weight percent, from about 1 to about 40 weight percent, or from about 15 to about 20 weight percent, with the amount of aminosilane being, for example, from about 50 to about 99.9 weight percent, from about 60 to about 99 weight percent, or from about 70 to about 95 weight percent; and where the total of the two components is equal to about 100 percent. The hole blocking layer thickness can be of any suitable value, such as for example, from about 0.01 to about 2 microns, from about 0.02 to about 0.5 micron, or from about 0.03 to about 0.2 micron.

There can be further included in the undercoat or hole blocking layer a number of polymer binders, for example polyacetal resins, such as polyvinyl butyral resins, glycoluril resins, benzoguanamine resins or mixtures of these resins, and which resins or mixtures of resins function primarily to disperse a mixture of the aminosilane and the epoxysilane, and other known suitable components that may be present in the undercoat.

Polymer Binder Examples

Undercoat layer examples of benzoguanamine binder resins can be represented by

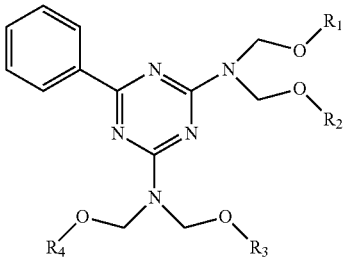

wherein $R_1$, $R_2$, $R_3$ and $R_4$ each independently represents a hydrogen atom or an alkyl chain as illustrated herein. In embodiments, the benzoguanamine resin is water soluble, dispersible, or indispersible. The benzoguanamine resin can be highly alkylated/alkoxylated, partially alkylated/alkoxylated, or a mixed alkylated/alkoxylated material. Specific examples of the benzoguanamine resin include methylated, n-butylated, or isobutylated, with examples of the benzoguanamine resin being CYMEL® 659, 5010, and 5011. CYMEL® benzoguanamine resins are commercially available from CYTEC Industries, Inc. Benzoguanamine resin examples can be generally comprised of amino resins generated from benzoguanamine, and formaldehyde. Benzoguanamine resins are known under various trade names including, but not limited to CYMEL®, BEETLE™, and UFORMITE™.

Glycoluril resin undercoat binder examples are

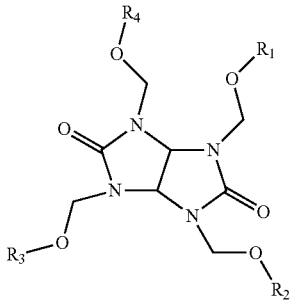

wherein $R_1$, $R_2$, $R_3$ and $R_4$ each independently represents a hydrogen atom or an alkyl chain as illustrated herein with, for example, 1 to about 8 carbon atoms, or with 1 to about 4 carbon atoms. The glycoluril resin can be water soluble, dispersible, or indispersible. Examples of the glycoluril resin include highly alkylated/alkoxylated, partially alkylated/alkoxylated, or mixed alkylated/alkoxylated, and more specifically, the glycoluril resin can be methylated, n-butylated, or isobutylated. Specific examples of the glycoluril resin include CYMEL® 1170, and 1171. CYMEL® glycoluril resins are commercially available from CYTEC Industries, Inc. Glycoluril resins are amino resins obtained from glycoluril and formaldehyde, and are known under various trade names including, but not limited to CYMEL® and POWDERLINK™. The glycoluril resins can be highly alkylated or partially alkylated.

In embodiments, polyacetal resin hole blocking or undercoat layer binders include polyvinyl butyrals formed by the known reactions between aldehydes and alcohols. The addition of one molecule of an alcohol to one molecule of an aldehyde produces a hemiacetal. Hemiacetals are rarely isolated because of their inherent instability, but rather are further reacted with another molecule of alcohol to form a stable acetal. Polyvinyl acetals are prepared from aldehydes and polyvinyl alcohols. Polyvinyl alcohols are high molecular weight resins containing various percentages of hydroxyl and acetate groups produced by hydrolysis of polyvinyl acetate. The conditions of the acetal reaction and the concentration of the particular aldehyde and polyvinyl alcohol used are controlled to form polymers containing predetermined proportions of hydroxyl groups, acetate groups, and acetal groups.

The polyvinyl butyral can be represented by

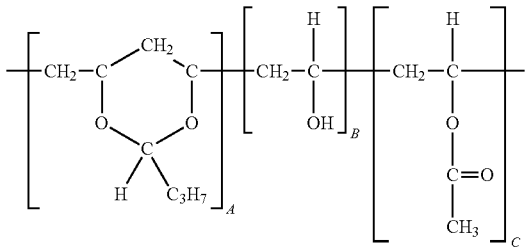

The proportions of polyvinyl butyral (A), polyvinyl alcohol (B), and polyvinyl acetate (C) are controlled, and they are randomly distributed along the molecule. The mole percent of polyvinyl butyral (A) is from about 50 to about 95, that of polyvinyl alcohol (B) is from about 5 to about 30, and that of polyvinyl acetate (C) is from about 0 to about 10. In addition to vinyl butyral (A), other vinyl acetals can be optionally present in the molecule including vinyl isobutyral (D), vinyl propyral (E), vinyl acetacetal (F), and vinyl formal (G). The total mole percent of all the monomeric units in one molecule is about 100.

Examples of hole blocking layer polyvinyl butyrals include BUTVAR™ B-72 ($M_w$=170,000 to 250,000, A=80, B=17.5 to 20, C=0 to 2.5), B-74 ($M_w$=120,000 to 150,000, A=80, B=17.5 to 20, C=0 to 2.5), B-76 ($M_w$=90,000 to 120,000, A=88, B=11 to 13, C=0 to 1.5), B-79 ($M_w$=50,000 to 80,000, A=88, B=10.5 to 13, C=0 to 1.5), B-90 ($M_w$=70,000 to 100,000, A=80, B=18 to 20, C=0 to 1.5), and B-98 ($M_w$=40,000 to 70,000, A=80, B=18 to 20, C=0 to 2.5), all commercially available from Solutia, St. Louis, Mo.; S-LEC™ BL-1 (degree of polymerization=300, A=63±3, B=37, C=3), BM-1 (degree of polymerization=650, A=65±3, B=32, C=3), BM-S (degree of polymerization=850, A>=70, B=25, C=4 to 6), BX-2 (degree of polymerization=1,700, A=45, B=33, G=20), all commercially available from Sekisui Chemical Co., Ltd., Tokyo, Japan.

The hole blocking layer can contain a single resin binder, a mixture of resin binders, such as from 2 to about 7, and the like, and where for the mixtures the percentage amounts selected for each resin varies, providing that the mixture contains about 100 percent by weight of the first and second resin, or the first, second, and third resin.

The hole blocking layer can, in embodiments, be prepared by a number of known methods, the process parameters being dependent, for example, on the photoconductor member desired. The hole blocking layer can be coated as a solution or a dispersion onto the substrate or on to the ground plane layer by the use of a spray coater, dip coater, extrusion coater, roller coater, wire-bar coater, slot coater, doctor blade coater, gravure coater, and the like, and dried at from about 40° Cxc to about 200° C. for a suitable period of time, such as from about 1 minute to about 10 hours, under stationary conditions or in an air flow. The coating can be accomplished to provide a final coating thickness of from about 0.01 to about 1 micron, from about 0.02 to about 0.5 micron, or from about 0.04 to about 0.05 micron after drying.

Photoconductor Layer Examples

The thickness of the photoconductive substrate layer depends on many factors including economical considerations, electrical characteristics, and the like; thus, this layer may be of a substantial thickness, for example over 3,000 microns, such as from about 500 to about 2,000 microns, from about 300 to about 700 microns, or of a minimum thickness. In embodiments, the thickness of this layer is from about 75 to about 300 microns, or from about 100 to about 150 microns.

The substrate may be opaque, substantially transparent, or be of a number of other suitable known forms, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors including strength desired and economical considerations. For a drum, as disclosed in a copending application referenced herein, this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device. In embodiments, where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, substrates selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer, in embodiments, is comprised of, for example, a number of known photogenerating pigments including, for example, Type V hydroxygallium phthalocyanine, Type IV or V titanyl phthalocyanine, chlorogallium phthalocyanine, and a resin binder like poly(vinyl chloride-co-vinyl acetate) copolymer, such as VMCH (available from Dow Chemical), or polycarbonate. Generally, the photogenerating layer can contain known photogenerating pigments, such as metal phthalocyanines, metal free phthalocyanines, alkylhydroxygallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer, in embodiments, is dependent primarily upon factors, such as photosensitivity, electrical properties, and mechanical considerations. The photogenerating layer binder resin is present in various suitable amounts of, for example, from about 1 to about 50 weight percent, and more specifically, from about 1 to about 10 weight percent, and which resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, polyurethanes, poly(vinyl alcohol), polyacrylonitrile, polystyrene, and the like. It is desirable to select a coating solvent that does not substantially disturb or adversely affect the other previously coated layers of the device. Generally, however, from about 5 to about 90 percent by volume of the photogenerating pigment is dispersed in about 10 to about 95 percent by volume of the resinous binder, or from about 20 to about 30 percent by volume of the photogenerating pigment is dispersed in about 70 to about 80 percent by volume of the resinous binder composition. In one embodiment, about 8 percent by volume of the photogenerating pigment is dispersed in about 92 percent by volume of the resinous binder composition. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicone and compounds of silicone and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones; polycyclic pigments such as dibromo anthanthrone pigments, perylene and perinone diamines; polynuclear aromatic quinones, azo pigments including bis-, tris- and tetrakis-azos, and the like dispersed in a film forming polymeric binder and fabricated by solvent coating techniques.

The photogenerating layer in embodiments is, more specifically, comprised of a titanyl phthalocyanine Type V pigment and a polymer, and where the Type V pigment is as illustrated in copending U.S. application Ser. No. 11/769,067, U.S. Publication No. 20090005555, now U.S. Pat. No. 7,888,502, and the copending applications referenced therein. In embodiments, the Type V titanyl phthalocyanine is prepared by treating a Type I titanyl phthalocyanine with a weak acid having a pKa of at least equal to or greater than about −0.25; dissolving the weak acid treated Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monohalobenzene thereby resulting in a high sensitivity titanyl phthalocyanine, such as Type V.

Examples of polymeric binder materials that can be selected as the matrix for the photogenerating layer components are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, epoxysilanes, polystyrene and acrylonitrile copolymers, poly(vinyl chloride), vinyl chloride and vinyl acetate copolymers, acrylate copolymers, alkyd resins, cellulosic film formers, poly(amideimide), styrene-butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be selected to mix, and thereafter apply the photogenerating layer coating mixture to the substrate, and more specifically, to the hole blocking layer or other layers like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like. The coating of the photogenerating layer on the UCL (undercoat layer) in embodiments of the present disclosure can be accomplished such that the final dry thickness of the photogenerating layer is as illustrated herein, and can be, for example, from about 0.01 to about 30 microns after being dried at, for example, about 40° C. to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. The hole blocking layer or UCL may be applied to the ground plane layer prior to the application of a photogenerating layer.

A suitable known adhesive layer can be included in the photoconductor. Typical adhesive layer materials include, for example, polyesters, polyurethanes, and the like. The adhesive layer thickness can vary, and in embodiments is, for example, from about 0.05 to about 0.3 micron. The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like. As optional adhesive layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicone nitride, carbon black, and the like, to provide, for example, in embodiments of the present disclosure, further desirable electrical and optical properties.

A number of charge transport materials, especially known hole transport molecules, may be selected for the charge transport layer, examples of which are aryl amines of the formulas/structures

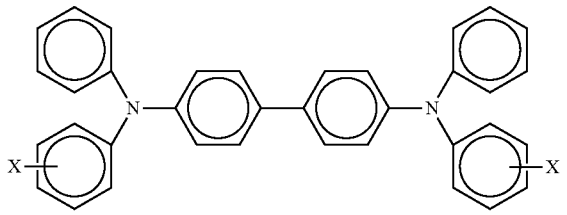

and

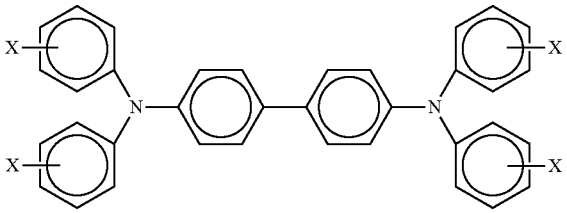

and which layer is generally of a thickness of from about 5 to about 75 microns, and more specifically, of a thickness of from about 10 to about 40 microns, wherein X is a suitable hydrocarbon like alkyl, alkoxy, and aryl; a halogen, or mixtures thereof, and especially those substituents selected from the group consisting of Cl and $CH_3$; and molecules of the following formulas

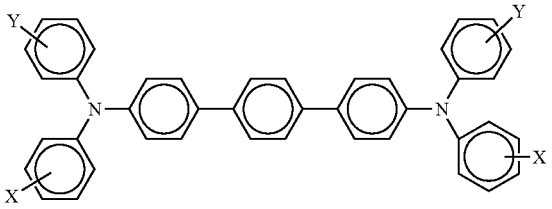

and

-continued

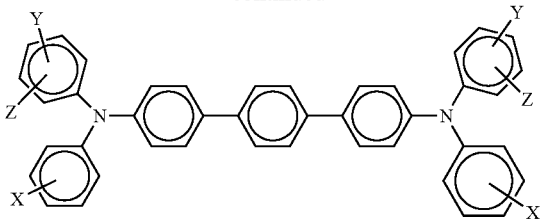

wherein X, Y and Z are a suitable substituent like a hydrocarbon, such as independently alkyl, alkoxy, or aryl; a halogen, or mixtures thereof, and wherein at least one of Y or Z is present. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments. At least one charge transport refers, for example, to 1, from 1 to about 7, from 1 to about 4, and from 1 to about 2.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer or layers include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 preferred. Generally, the transport layer contains from about 10 to about 75 percent by weight of the charge transport material, and more specifically, from about 35 to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules selected for the charge transport layer or layers, and present in various effective amounts include, for example, pyrazolines such as 1-phenyl-3-(4'-diethylamino styryl)-5-(4"-diethylamino phenyl) pyrazoline; aryl amines such as N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[b-terphenyl]-4,4'-diamine, and N,N'-diphenyl-N,N'-bis(3-chlorophenyl)-[p-terphenyl]-4,4'-diamine; hydrazones such as N-phenyl-N-methyl-3-(9-ethyl) carbazyl hydrazone, and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material and a polymeric charge transport material.

In embodiments, the charge transport component can be represented by the following formulas/structures

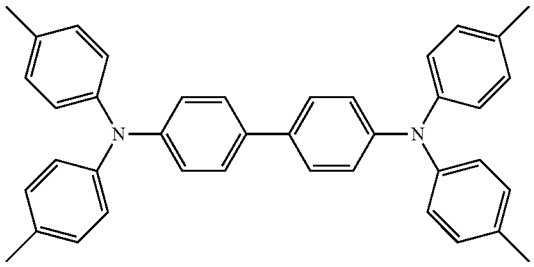

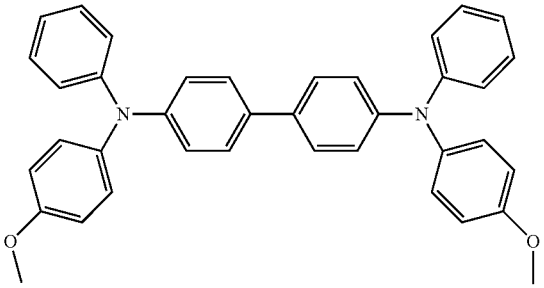

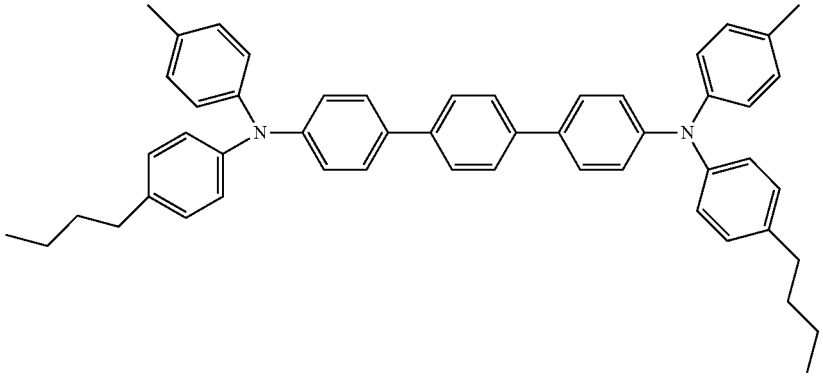

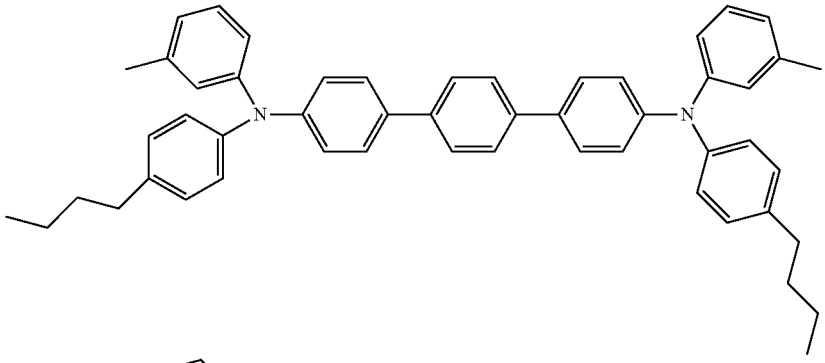

and

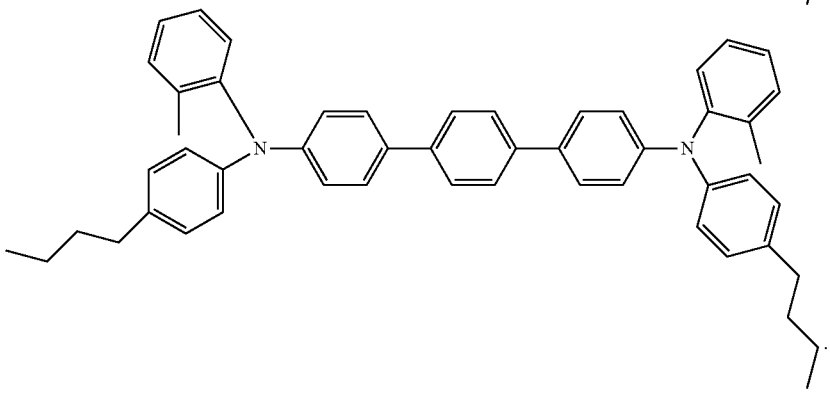

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The amount of the antioxidant in at least one of the charge transport layers is from about 0 to about 20 weight percent, from about 1 to about 10 weight percent, or from about 3 to about 8 weight percent.

A number of processes may be used to mix, and thereafter apply the charge transport layer or layers coating mixture to the photogenerating layer. Typical application techniques include spraying, dip coating, and roll coating, wire wound rod coating, and the like. Drying of the charge transport deposited coating may be effected by any suitable conventional technique such as oven drying, infrared radiation drying, air drying, and the like.

The thickness of each of the charge transport layers in embodiments is, for example, from about 10 to about 75 microns, from about 15 to about 50 microns, but thicknesses outside these ranges may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to about 200:1, and in some instances 400:1. The charge transport layer is substantially nonabsorbing to visible light or radiation in the region of intended use, but is electrically "active" in that it allows the injection of photogenerated holes from the photoconductive layer or photogenerating layer, and allows these holes to be transported through itself to selectively discharge a surface charge on the surface of the active layer.

The thickness of the continuous charge transport layer selected depends upon the abrasiveness of the charging (bias charging roll), cleaning (blade or web), development (brush), transfer (bias transfer roll), and the like in the system employed, and can be up to about 10 microns. In embodiments, the thickness for each charge transport layer can be, for example, from about 1 to about 5 microns. Various suitable and conventional methods may be used to mix, and thereafter apply an overcoat top charge transport layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoat layer of this disclosure should transport holes during imaging, and should not have too high a free carrier concentration.

The following Examples are provided. All proportions are by weight unless otherwise indicated.

Titanyl Phthalocyanine Type V Photogenerating Pigment Preparation

Preparation of Type I Titanyl Phthalocyanine

A Type I titanyl phthalocyanine (TiOPc) was prepared as follows. To a 300 milliliter three-necked flask fitted with mechanical stirrer, condenser and thermometer maintained under an argon atmosphere were added 3.6 grams (0.025 mole) of 1,3-diiminoisoindoline, 9.6 grams (0.075 mole) of o-phthalonitrile, 75 milliliters (80 weight percent) of tetrahydronaphthalene, and 7.11 grams (0.025 mole) of titanium tetrapropoxide (all obtained from Aldrich Chemical Company, except phthalonitrile which was obtained from BASF). The resulting mixture (20 weight percent of solids) was stirred and warmed to reflux (about 198° C.) for 2 hours. The resultant black suspension was cooled to about 150° C., and then was filtered by suction through a 350 milliliter M-porosity sintered glass funnel, which had been preheated with boiling dimethyl formamide (DMF). The solid Type I TiOPc product resulting was washed with two 150 milliliter portions of boiling DMF, and the filtrate, initially black, became a light blue-green color. The solid was slurried in the funnel with 150 milliliters of boiling DMF and the suspension was filtered. The resulting solid was washed in the funnel with 150 milliliters of DMF at 25° C., and then with 50 milliliters of methanol. The resultant shiny purple solid was dried at 70° C. overnight, about 18 hours, to yield 10.9 grams (76 percent) of pigment, which was identified as Type I TiOPc on the basis of its X-ray powder diffraction trace. Elemental analysis of the product indicated C, 66.54; H, 2.60; N, 20.31; and Ash ($TiO_2$), 13.76. TiOPc requires (theory): C, 66.67; H, 2.80; N, 19.44; and Ash, 13.86.

A Type I titanyl phthalocyanine can also be prepared in 1 chloronaphthalene or N-methylpyrrolidone as follows. A 250 milliliter three-necked flask fitted with mechanical stirrer, condenser, and thermometer maintained under an atmosphere of argon was charged with 1,3-diiminoisoindolene (14.5 grams), titanium tetrabutoxide (8.5 grams), and 75 milliliters of 1-chloronaphthalene (ClNp) or N methylpyrrolidone. The mixture was stirred and warmed. At 140° C. the mixture turned dark green and began to reflux. At this time the vapor (which was identified as n-butanol by gas chromatography) was allowed to escape to the atmosphere until the reflux temperature reached 200° C. The reaction was maintained at this temperature for two hours, and then was cooled to 150° C. The product was filtered through a 150 milliliter M-porosity sintered glass funnel, which was preheated to approximately 150° C. with boiling DMF, and then washed thoroughly with three portions of 150 milliliters of boiling DMF, followed by washing with three portions of 150 milliliters of DMF at room temperature, and then three portions of 50 milliliters of methanol, thus providing 10.3 grams (72 percent yield) of a shiny purple pigment, which was identified as Type I TiOPc by X-ray powder diffraction (XRPD).

Treatment of Type I Titanyl Phthalocyanine with a Weak Acid:

Twenty grams of the above prepared Type I titanyl phthalocyanine were mixed with a mixture of water and glacial acetic acid with a pKa of 4.76 (20/1, v/v) for half an hour, and the mixture was subsequently hose vacuum filtered through a 600 milliliter Buchner funnel with a fibrous glass frit of from about 4 to about 8 microns in porosity. The pigment resulting was then well mixed with 800 milliliters of hot water (>90° C.), and vacuum filtered in the funnel. The pigment was then mixed with 800 milliliters of cold water, thoroughly mixed, and vacuum filtered in the funnel. The final water filtrate was measured for conductivity, which was below about 10 microsiemens. The resulting wet cake was then thoroughly mixed with 800 milliliters of methanol, and vacuum filtered in the funnel. The wet cake was dried at 65° C. under vacuum, and the product obtained was identified as Type I TiOPc on the basis of its X-ray powder diffraction trace.

Preparation of Type V Titanyl Phthalocyanine:

Fifty grams of the weak acid treated TiOPc Type I, prepared above, were dissolved in 300 milliliters of a trifluoroacetic acid (pKa of −0.25)/methylene chloride (1/4, volume/volume) mixture for 1 hour in a 500 milliliter Erlenmeyer flask with a magnetic stirrer. At the same time, 2,600 milliliters of methanol/methylene chloride (1/1, volume/volume) quenching mixture were cooled with a dry ice bath for 1 hour in a 3,000 milliliter beaker with a magnetic stirrer, and the final temperature of the mixture was about −25° C. The resulting TiOPc solution was transferred to a 500 milliliter addition funnel with a pressure-equalization arm, and added into the cold quenching mixture over a period of 30 minutes. The mixture obtained was then allowed to stir for an additional 30 minutes, and subsequently hose-vacuum filtered through a 2,000 milliliter Buchner funnel with a fibrous glass frit of from about 4 to about 8 microns in porosity. The pigment resulting was then well mixed with 1,500 milliliters of methanol in the funnel, and vacuum filtered. The pigment was then well mixed with 1,000 milliliters of hot water (>90° C.), and vacuum filtered in the funnel four times. The pigment was then well mixed with 1,500 milliliters of cold water, and vacuum filtered in the funnel. The final water filtrate was measured for conductivity, which was below about 10 microsiemens. The resulting wet cake contained approximately 50 weight percent of water. A small portion of the wet cake was dried at 65° C. under vacuum, and a blue pigment was obtained. A representative XRPD of this pigment after quenching with methanol/methylene chloride was identified by XRPD as Type Y titanyl phthalocyanine.

The remaining portion of the wet cake was redispersed in 700 grams of monochlorobenzene (MCB) in a 1,000 milliliter bottle and rolled for an hour. The dispersion was vacuum filtered through a 2,000 milliliter Buchner funnel with a fibrous glass frit of 4 to 8 microns in porosity over a period of two hours. The pigment was then well mixed with 1,500 milliliters of methanol and filtered in the funnel twice. The final pigment was vacuum dried at 60 to 65° C. for two days. Approximately 45 grams of the pigment were obtained. The XRPD of the resulting pigment after the MCB conversion was designated as a Type V titanyl phthalocyanine. The Type V titanyl phthalocyanine had an X-ray diffraction pattern having characteristic diffraction peaks at a Bragg angle of 2 theta ±0.2° (degrees) at about 9.0°, 9.6°, 24.0°, and 27.2°.

Comparative Example 1

A ground plane layer of zirconium/titanium was prepared by vacuum sputtering or vacuum evaporation of a 0.02 micron thick zirconium/titanium metal layer onto a biaxially oriented polyethylene naphthalate substrate (KALEDEX™ 2000) having a thickness of 3.5 mils.

Subsequently, there was applied on the above ground plane, with an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 0.04 micron. An adhesive layer was then deposited by applying a wet coating over the blocking layer, using an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 0.02 micron.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 44.65 grams of monochlorobenzene (MCB) into a 4 ounce glass bottle. To this solution were added 2.4 grams of titanyl phthalocyanine Type V, and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of monochlorobenzene, and added to the titanyl phthalocyanine dispersion. This slurry was then placed on a shaker for 10 minutes. The resulting dispersion was, thereafter, applied to the above adhesive interface with an extrusion coater to form a photogenerating layer having a wet thickness of 0.50 mil. The photogenerating layer was dried at 120° C. for 1 minute in a forced air oven to form a dry photogenerating layer having a thickness of 0.8 micron.

The photogenerating layer was then coated with a single charge transport layer prepared by introducing into an amber glass bottle in a weight ratio of 50/50, N,N'-bis(methylphenyl)-1,1-biphenyl-4,4'-diamine (TBD) and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent, for example 25 percent.

In another embodiment, the resulting photogenerating layer may be coated with a dual charge transport layer. The first charge transport layer is prepared by introducing into an amber glass bottle in a weight ratio of 50/50, N,N'-bis(methylphenyl)-1,1-biphenyl-4,4'-diamine (TBD) and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture is then dissolved in methylene chloride to form a solution containing 15.6 percent by weight solids. This solution is applied on the photogenerating layer to form the charge transport layer coating that upon drying (120° C. for 1 minute) is believed to be of a thickness of 14.5 microns. During this coating process, the humidity is equal to or less than 30 percent, for example 25 percent.

The above first pass charge transport layer (CTL) is then overcoated with a second top charge transport layer in a second pass. The charge transport layer solution of the top layer is prepared by introducing into an amber glass bottle in a weight ratio of 35/65 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture is then dissolved in methylene chloride to form a solution containing 15 percent by weight solids. This solution is applied, using a 2 mil Bird bar, on the bottom layer of the charge transport layer to form a coating that upon drying (120° C. for 1 minute) is believed to have a thickness of 14.5 microns. During this coating process, the humidity is equal to or less than 15 percent. The total two-layer CTL thickness is believed to be about 29 microns.

Example I

A photoconductor was prepared by repeating the process of Comparative Example 1, single charge transport layer, except that there was further added to the hole blocking layer solution 10 weight percent of the epoxysilane, 3-glycidoxypropyl trimethoxysilane, and the resulting hole blocking layer was comprised of 90 weight percent of 3-aminopropyl triethoxysilane (γ-APS), and 10 weight percent of the epoxysilane, and which layer of a thickness of 0.04 micron was coated and dried (120° C./1 minute) on the above photoconductor ground plane layer.

Example II

A photoconductor was prepared by repeating the process of Comparative Example 1, single charge transport layer, except that there was further added to the hole blocking layer solution 20 weight percent of the epoxysilane, 3-glycidoxypropyl trimethoxysilane, and the resulting hole blocking layer was comprised of 80 weight percent of 3-aminopropyl triethoxysilane (γ-APS), and 20 weight percent of the epoxysilane, and which layer of a thickness of 0.04 micron was coated and dried (120° C./1 minute) on the above photoconductor ground plane layer.

Example III

A number of photoconductors can be prepared by repeating the process of Example II except that there is selected as the epoxysilane 2-(3,4-epoxycyclohexyl)ethyltrimethoxysilane, (3-glycidoxypropyl)triethoxysilane, (3-glycidoxypropyl)methyldiethoxysilane, (3-glycidoxypropyl)dimethylethoxysilane, (3-glycidoxypropyl)dimethoxymethylsilane, and trimethoxy[2-(7-oxabicyclo[4.1.0]hept-3-yl)ethyl]silane.

Comparative Example 2

On a 30 millimeter aluminum drum substrate, a 3-component undercoat layer was prepared and deposited thereon as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was then coated by a dip coater on the above aluminum drum substrate, and the coating solution layer was pre-heated at 59° C. for 13 minutes, humidified at 58° C. (dew point=54° C.) for 17 minutes, and dried at 135° C. for 8 minutes. The thickness of the undercoat layer obtained was approximately 1.3 microns.

A photogenerating layer comprising chlorogallium phthalocyanine (Type C) was deposited on the above undercoat layer at a thickness of about 0.2 micron. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, Dow Chemical Company), 15 grams of n-butyl acetate, and 30 grams of xylene. The resulting mixture was milled in an Attritor mill with about 200 grams of 1 millimeter Hi-Bea borosilicate glass beads for about 3 hours. The dispersion mixture obtained was then filtered through a 20 μm Nylon cloth filter, and the solids content of the dispersion was diluted to about 6 weight percent.

Subsequently and separately, a 14 micron (A) and 11 micron (B) charge transport layer was coated on top of the photogenerating layer from a solution prepared by dissolving N,N'-diphenyl-N,N-bis(3-methylphenyl)-1,1'-biphenyl-4,4'-diamine (mTBD, 4 grams), and a film forming polymer binder PCZ-400 [poly(4,4'-dihydroxy-diphenyl-1-1-cyclohexane, $M_w$=40,000)] available from Mitsubishi Gas Chemical Company, Ltd. (6 grams) in a solvent mixture of 21 grams of tetrahydrofuran (THF) and 9 grams of toluene. The charge transport layer of PCZ-400/mTBD=60/40 was dried at about 120° C. for about 40 minutes.

Example IV

Photoconductors were prepared by repeating the process of Comparative Example 2 except the undercoat layer solution contained 50 grams of 3-aminopropyl triethoxysilane (γ-APS), 12.5 grams of the epoxysilane, 3-glycidoxypropyltrimethoxysilane, 41.2 grams of water, 15 grams of acetic acid, 684.8 grams of denatured alcohol, and 200 grams of heptane. The solution was coated on the aluminum substrate, and subsequently dried at 140° C. for 30 minutes, and a 0.2 micron thick undercoat layer comprised of 80 weight percent of 3-aminopropyl triethoxysilane (γ-APS), and 20 weight percent of the epoxysilane was obtained.

Electrical Property Testing

The above prepared photoconductors of Comparative Example 1, Examples I and II, Comparative Example 2, and Example IV were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic (PIDC) curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The photoconductors were tested at surface potentials of 500 volts with the exposure light intensity incrementally increased by regulating a series of neutral density filters; the exposure light source was a 780 nanometer light emitting diode. The xerographic simulation was completed in an environmentally controlled light tight chamber at dry conditions (10 percent relative humidity and 22° C.).

The above prepared Comparative Example 1 and the Examples I and II belt photoconductors exhibited substantially similar PIDCs. Similarly, the above prepared Comparative Example 2 and the Example IV drum photoconductors exhibited substantially similar PIDCs. Thus, incorporation of the epoxysilane into the hole blocking layer did not adversely affect the electrical properties of the photoconductors.

Charge Deficient Spots (CDS) Measurement

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the microdefect levels of an electrophotographic imaging member or photoconductor. The method of U.S. Pat. No. 5,703,487, designated as field-induced dark decay (FIDD), involves measuring either the differential increase in charge over and above the capacitive value, or measuring reduction in voltage below the capacitive value of a known imaging member and of a virgin imaging member, and comparing differential increase in charge over and above the capacitive value or the reduction in voltage below the capacitive value of the known imaging member and of the virgin imaging member.

U.S. Pat. Nos. 6,008,653, recited above, and 6,150,824, the disclosures of each patent being totally incorporated herein by reference, disclose a method for detecting surface potential charge patterns in an electrophotographic imaging member with a floating probe scanner. A Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, and a floating fixture which maintains a substantially constant distance between the probe and the imaging surface. A constant voltage charge is applied to the imaging surface (photoconductor) prior to relative movement of the probe and the imaging surface past each other, and the probe is synchronously biased to within about +/−300 volts of the average surface potential of the imaging surface to prevent breakdown, while measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of 20 volts is commonly chosen to count charge deficient spots (CDS). The above prepared belt photoconductors of Comparative Example 1 and Examples I and II were measured for CDS counts (counts/cm$^2$) using the above-described FPS technique, and the results follow in Table 1. The number values below, such as 16.3, represent the measured CDS values.

TABLE 1

| Example Number | CDS (counts/cm$^2$) |
|---|---|
| Comparative Example 1, Aminosilane Hole Blocking Layer | 16.3 |
| Example I, Aminosilane/epoxysilane = 90/10 Hole Blocking Layer | 11.0 |
| Example II, Aminosilane/epoxysilane = 80/20 Hole Blocking Layer | 8.9 |

Incorporation of the epoxysilane into the hole blocking layer reduced the CDS by about 30 (Example I) and 45 percent (Example II), respectively.

Lateral Charge Migration (LCM) Test

LCM resistance was then tested for the Comparative Example 1 and Examples I and II belt photoconductors as following. The photoconductor strip was mounted onto a drum and exposed to a running scorotron device. The scorotron grid was set to ground in order not to charge the photoconductor. After exposure, the photoconductors were printed using a print template with lines of various widths (1 to 5 pixels). The samples were ranked as a function of missing lines, where no missing lines was ranked as Grade 5 or G5 (most LCM resistant), and all lines missing were ranked Grade 1 or G1 (least LCM resistant). The results are shown in Table 2.

TABLE 2

| Example Number | LCM |
|---|---|
| Comparative Example 1, Aminosilane Hole Blocking Layer | G2 |
| Example I, Aminosilane/epoxysilane = 90/10 Hole Blocking Layer | G3 |
| Example II, Aminosilane/epoxysilane = 80/20 Hole Blocking Layer | G4 |

Incorporation of the epoxysilane into the hole blocking layer reduced the LCM by about 50 (Example I) and 100 percent (Example II), respectively.

Background Test

The above prepared drum photoconductors of Comparative Example 2 and Example IV were acclimated in A zone (80° F./80 percent humidity) for 24 hours, and then printed from a Xerox Corporation DC5000 printer at a process speed of 52 millimeters/second. The background or the grayness of the prints was visually evaluated. The darker in color the print, the higher the background; a background of Grade 1 or G1 refers to no background, and a background of Grade 7 or G7 refers to the highest background. The background data results are provided in Table 3.

TABLE 3

| | A Zone Background |
|---|---|
| Comparative Example 2 (A), 3-Component Undercoat Layer with 14 Micron Charge Transport Layer | G3 |
| Comparative Example 2 (B), 3-Component Undercoat Layer with 11 Micron Charge Transport Layer | G5 |
| Example IV (A), Aminosilane/epoxysilane Undercoat Layer with 14 Micron Charge Transport Layer | G3 |
| Example IV (B), Aminosilane/epoxysilane Undercoat Layer with 11 Micron Charge Transport Layer | G3 |

With an 11 micron charge transport layer, the disclosed aminosilane/epoxysilane undercoat layer photoconductor of Example IV (B) exhibited about a 40 percent less A zone background than the 3-component undercoat layer photoconductors of Comparative Example 2 (B). With a 14 micron charge transport layer, comparable A zone background was observed. The disclosed undercoat layer photoconductor was more background resistant than the 3-component undercoat layer photoconductor, especially with a thin charge transport layer, such as 11 microns, which enables a high resolution photoconductor where a thin charge transport layer is used.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a substrate, a ground plane layer, an undercoat layer thereover, and wherein the undercoat layer comprises an aminosilane and an epoxysilane; a photogenerating layer, and a charge transport layer, and wherein said aminosilane is present in an amount of from about 65 to about 99 weight percent, said epoxysilane is present in an amount of from about 1 to about 35 weight percent, and wherein the total of said components in said undercoat layer is about 100 percent.

2. A photoconductor in accordance with claim 1 wherein said ground plane layer is situated between said substrate and said undercoat layer.

3. A photoconductor in accordance with claim 2 wherein said ground plane is comprised of titanium, zirconium, aluminum, gold, or a gold containing material.

4. A photoconductor in accordance with claim 1 wherein said aminosilane is present in an amount of from about 80 to about 90 weight percent; said epoxysilane is present in an amount of from about 10 to about 20 weight percent, and wherein the total of said components in said undercoat layer is about 100 percent.

5. A photoconductor in accordance with claim 1 wherein said aminosilane is represented by

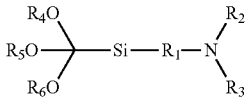

wherein $R_1$ is an alkylene group containing from 1 to about 25 carbon atoms; $R_2$ and $R_3$ are independently selected from the group consisting of at least one of hydrogen, alkyl containing from 1 to about 5 carbon atoms, and aryl containing from 6 to about 36 carbon atoms; and $R_4$, $R_5$ and $R_6$ are independently selected from an alkyl group containing from 1 to about 6 carbon atoms.

6. A photoconductor in accordance with claim 1 wherein said aminosilane is at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilyl propylamino)ethylamino]-3-propionate, (N,N'-dimethyl-3-amino)propyltriethoxysilane, N,N-dimethylaminophenyl triethoxysilane, trimethoxysilyl propyldiethylene triamine, and mixtures thereof; and said charge transport layer is comprised of 1, 2, or 3, layers.

7. A photoconductor in accordance with claim 1 wherein said epoxysilane is represented by

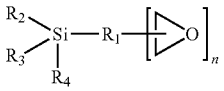

wherein $R_1$ is an alkylene group or an alkoxy group each containing from 1 to about 18 carbon atoms, and connecting to either one or two sites on the epoxy ring; $R_2$, $R_3$ and $R_4$ are independently selected from the group consisting of an alkyl group or an alkoxy group containing from 1 to about 10 carbon atoms; and n is the number of the epoxy rings of from 1 to about 8.

8. A photoconductor in accordance with claim 7 wherein $R_1$ alkylene group or alkoxy group contains from 1 to about 8 carbon atoms; $R_2$, $R_3$ and $R_4$ are independently methyl, ethyl, n-propyl, isopropyl, n-butyl, isobutyl, methoxy, ethoxy, n-propoxy, isopropoxy, n-butoxy, isobutoxy; and n is the number of the epoxy rings of from 1 to about 4.

9. A photoconductor in accordance with claim 1 wherein said epoxysilane is at least one of (3-glycidoxypropyl)trimethoxysilane, 2-(3,4-epoxycyclohexyl)ethyltrimethoxysilane, (3-g lycidoxypropyl)triethoxysilane, (3-glycidoxypropyl)methyldiethoxysilane, (3-glycidoxypropyl) dimethylethoxysilane, (3-glycidoxypropyl) dimethoxymethylsilane, trimethoxy[2-(7-oxabicyclo[4.1.0] hept-3-yl)ethyl]silane, and mixtures thereof.

10. A photoconductor in accordance with claim 1 wherein said epoxysilane is (3-glycidoxypropyl)trimethoxysilane or 2-(3,4-epoxycyclohexyl)ethyltrimethoxysilane.

11. A photoconductor in accordance with claim 1 wherein said aminosilane is 3-aminopropyl triethoxysilane.

12. A photoconductor in accordance with claim 1 wherein the thickness of the undercoat layer is from about 0.01 to about 2 microns.

13. A photoconductor in accordance with claim 1 wherein the thickness of the undercoat layer is from about 0.03 to about 0.5 micron.

14. A photoconductor in accordance with claim 1 wherein said charge transport layer is comprised of at least one of

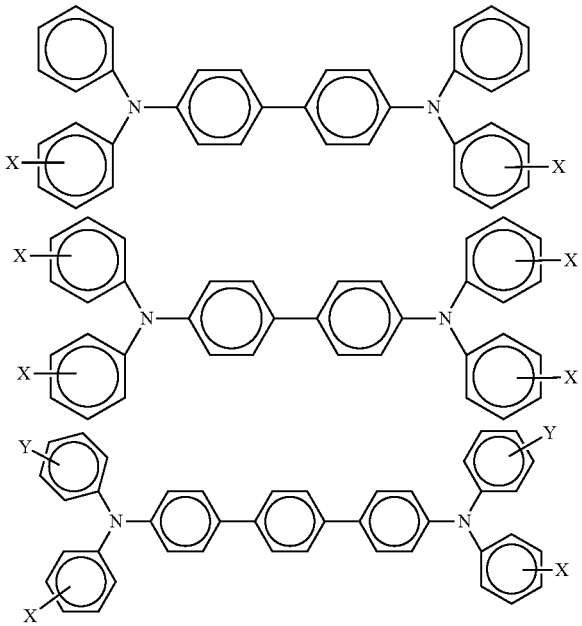

and

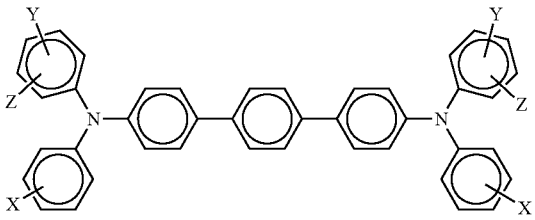

wherein X, Y, and Z are independently selected from the group consisting of alkyl, alkoxy, aryl, halogen, and mixtures thereof.

15. A photoconductor in accordance with claim 1 wherein said charge transport layer is comprised of a component selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine; and said aminosilane is at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-propionate, (N,N'-dimethyl 3-amino)propyl triethoxysilane, N,N-dimethylaminophenyl triethoxysilane, trimethoxysilyl propyldiethylene triamine, and mixtures thereof.

16. A photoconductor in accordance with claim 1 wherein said photogenerating layer is comprised of at least one photogenerating pigment.

17. A photoconductor in accordance with claim 16 wherein said photogenerating pigment is comprised of a titanyl phthalocyanine.

18. A photoconductor in accordance with claim 1 wherein said charge transport layer is comprised of a charge transport component and a resin binder, and wherein said photogenerating layer is comprised of at least one photogenerating pigment and a resin binder; and wherein said photogenerating layer is situated between said undercoat layer and said charge transport layer; and wherein said aminosilane is represented by

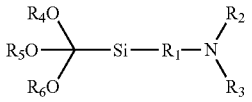

wherein $R_1$ is an alkylene group containing from 1 to about 18 carbon atoms; $R_2$ and $R_3$ are independently selected from the group consisting of at least one of hydrogen, alkyl containing from 1 to about 5 carbon atoms, and aryl containing from about 6 to about 18 carbon atoms; and $R_4$, $R_5$ and $R_6$ are independently selected from an alkyl group containing from 1 to about 6 carbon atoms, and said epoxysilane is represented by

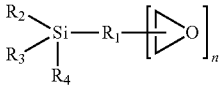

wherein $R_1$ is alkylene or alkoxy, each containing from 1 to about 8 carbon atoms; $R_2$, $R_3$ and $R_4$ are independently selected from the group consisting of alkyl and alkoxy, each containing from 1 to about 6 carbon atoms; and n is the number of the epoxy rings of from 1 to about 4.

19. A photoconductor in accordance with claim 1 wherein said undercoat layer further contains a resin binder selected from the group consisting of polyacetal resins, polyvinyl butyral resins, glycoluril resins, benzoguanamine resins, and mixtures thereof.

20. A photoconductor in accordance with claim 1 wherein said aminosilane is an aminoalkyl trialkoxy silane.

21. A photoconductor in accordance with claim 1 wherein said photogenerating layer contains a titanyl phthalocyanine pigment; said aminosilane is at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, and N-2-aminoethyl-3-aminopropyl trimethoxysilane; said charge transport layer is comprised of aryl amine molecules and a polymer; said charge transport layer is 1 or 2 layers; and wherein said epoxysilane is at least one of (3-glycidoxypropyl)trimethoxysilane, 2-(3,4-epoxycyclohexyl)ethyltrimethoxysilane, (3-glycidoxypropyl)triethoxysilane, (3-glycidoxypropyl) methyldiethoxysilane, (3-glycidoxypropyl)dimethylethoxysilane, (3-glycidoxypropyl)dimethoxymethylsilane, or trimethoxy[2-(7-oxabicyclo[4.1.0]hept-3-yl)ethyl]silane.

22. A photoconductor in accordance with claim 1 wherein said aminosilane is represented by

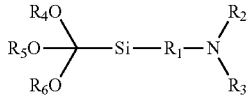

wherein $R_1$ is an alkylene; $R_2$ and $R_3$ are alkyl, hydrogen, aryl, or a poly(alkyleneamino) group, and each $R_4$, $R_5$, and $R_6$ is alkyl; said photogenerating layer is comprised of titanyl phthalocyanine Type V, and said epoxysilane is represented by at least one of

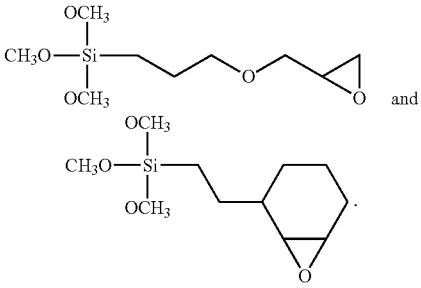

23. A photoconductor in accordance with claim 1 wherein said epoxysilane is represented by

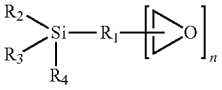

and wherein $R_1$ is alkylene or alkoxy; $R_2$, $R_3$ and $R_4$ are independently selected from the group consisting of alkyl and alkoxy, and n is a number of from 1 to about 10.

24. A photoconductor in accordance with claim 1 further including an adhesive layer.

25. A photoconductor consisting of a substrate, a ground plane layer, a hole blocking layer thereover consisting of the reaction product of an aminosilane and an epoxysilane, a photogenerating layer, and at least one charge transport layer, and wherein said aminosilane is present in an amount of from about 65 to about 99 weight percent, said epoxysilane is present in an amount of from about 1 to about 35 weight percent, and wherein the total of said components in said undercoat layer is about 100 percent.

26. A photoconductor in accordance with claim 25 wherein said aminosilane is an aminoalkyl alkoxy silane, and said at least one charge transport layer is 1, 2 or 3 layers.

27. A photoconductor in accordance with claim 25 wherein said aminosilane is at least one of 3-aminopropyl triethoxysilane N-aminoethyl-3-aminopropyl trimethoxysilane, and (N,N'-dimethyl-3-amino)propyl triethoxysilane, and said epoxysilane is represented by

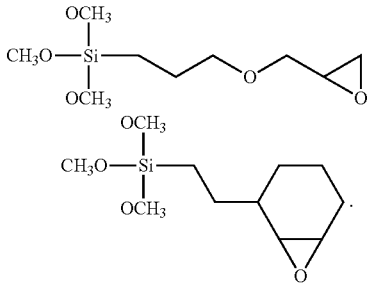

28. A photoconductor comprised of a hole blocking layer of a mixture of an aminosilane and an epoxysilane, wherein the aminosilane is at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris (ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilyl propylamino)ethylamino]-3-propionate, (N,N'-dimethyl-3-amino)propyltriethoxysilane, N,N-dimethylaminophenyl triethoxysilane, trimethoxysilyl propyldiethylene triamine, and mixtures thereof; and wherein said epoxysilane is at least one of (3-glycidoxypropyl)trimethoxysilane, 2-(3,4-epoxycyclohexyl)ethyltrimethoxysilane, (3-glycidoxypropyl)triethoxysilane, (3-glycidoxypropyl)methyldiethoxysilane, (3-glycidoxypropyl) dimethylethoxysilane, (3-glycidoxypropyl) dimethoxymethylsilane, trimethoxy[2-(7-oxabicyclo[4.1.0] hept-3-yl)ethyl]silane, and mixtures thereof; wherein said hole blocking layer is contained on a supporting substrate, and said photoconductor includes a photogenerating layer in contact with said hole blocking layer, and a charge transport layer in contact with said photogenerating layer, and wherein said aminosilane is present in an amount of from about 65 to about 99 weight percent, said epoxysilane is present in an amount of from about 1 to about 35 weight percent, and wherein the total of said components in said undercoat layer is about 100 percent.

29. A photoconductor in accordance with claim 28 wherein the amount of said aminosilane is from about 80 to about 90 weight percent, and the amount of said epoxysilane is from about 10 to about 20 weight percent, and wherein the total thereof is 100 percent and wherein said aminosilane is an aminopropyl triethoxysilane, and said epoxysilane is (3-glycidoxypropyl)trimethoxysilane.

30. A photoconductor in accordance with claim 28 further including an adhesive layer.

* * * * *